US007123230B2

(12) United States Patent
Park et al.

(10) Patent No.: US 7,123,230 B2
(45) Date of Patent: Oct. 17, 2006

(54) SYSTEM AND METHOD FOR REDUCING OFF-CURRENT IN THIN FILM TRANSISTOR OF LIQUID CRYSTAL DISPLAY DEVICE

(75) Inventors: Jae-Deok Park, Gyeongsangbuk-do (KR); Byeong-Koo Kim, Gyeongsangbuk-do (KR); Kee-Jong Kim, Seoul (KR)

(73) Assignee: LG.Philips LCD Co., Ltd., Seoul (KR)

( * ) Notice: Subject to any disclaimer, the term of this patent is extended or adjusted under 35 U.S.C. 154(b) by 486 days.

(21) Appl. No.: 10/726,518

(22) Filed: Dec. 4, 2003

(65) Prior Publication Data

US 2004/0108987 A1 Jun. 10, 2004

(30) Foreign Application Priority Data

Dec. 4, 2002 (KR) ..... 10-2002-0076723

(51) Int. Cl.
*G09G 3/36* (2006.01)

(52) U.S. Cl. ..... 345/92; 345/87; 345/95; 345/100; 345/211

(58) Field of Classification Search ..... 345/92, 345/87, 100
See application file for complete search history.

(56) References Cited

U.S. PATENT DOCUMENTS 4,621,260 A 11/1986 Suzuki et al.
5,349,366 A * 9/1994 Yamazaki et al. ..... 345/92
5,430,460 A * 7/1995 Takabatake et al. ..... 345/96
5,506,598 A * 4/1996 Shimada et al. ..... 345/92
5,764,321 A * 6/1998 Koyama et al. ..... 349/48
5,798,744 A * 8/1998 Tanaka et al. ..... 345/92
5,945,866 A 8/1999 Fonash et al.
6,100,865 A * 8/2000 Sasaki ..... 345/92
6,317,109 B1 * 11/2001 Lee ..... 345/87
6,531,996 B1 3/2003 Murade
7,038,644 B1 * 5/2006 Kim et al. ..... 345/87

* cited by examiner

*Primary Examiner*—Bipin Shalwala
*Assistant Examiner*—Sameer Gokhale
(74) *Attorney, Agent, or Firm*—McKenna Long & Aldridge LLP

(57) ABSTRACT

A system for reducing an OFF-current in a thin film transistor of a liquid crystal display device includes gate and data lines crossing each other, a pixel thin film transistor including gate, source and drain electrodes, the gate electrode connected to the gate line and the source electrode connected to the data line, a liquid crystal capacitor connected to the drain electrode of the pixel thin film transistor, a first switch thin film transistor connected to a first end of the data line, a second switch thin film transistor connected to a first end of the gate line, a first voltage source electrically connected to the drain electrode of the pixel thin film transistor, a second voltage source connected to a source electrode of the first switch thin film transistor, a third voltage source connected to gate electrodes of the first and second switch thin film transistors, and a fourth voltage source connected to a source electrode of the second switch thin film transistor.

39 Claims, 10 Drawing Sheets

SYSTEM AND METHOD FOR REDUCING OFF-CURRENT IN THIN FILM TRANSISTOR OF LIQUID CRYSTAL DISPLAY DEVICE

The present invention claims the benefit of Korean Patent Application No. 2002-76723 filed in Korea on Dec. 4, 2002, which is hereby incorporated by reference.

BACKGROUND OF THE INVENTION

1. Field of the Invention

The present invention relates to a liquid crystal display device including a thin film transistor and more particularly, to a system and a method for reducing OFF-current in a thin film transistor of a liquid crystal display device.

2. Discussion of the Related Art

Due to rapid development in information technology, display devices have to display large amounts of information. Although cathode ray tube (CRT) devices have been commonly used as display devices, flat panel display devices have been developed that are thin, light weight, and low in power consumption. Among these, liquid crystal display (LCD) devices have been used in notebook computers and desktop monitors because of their superior image resolution, color image display, and display image quality.

The LCD devices include an upper substrate, a lower substrate, and a liquid crystal material layer disposed between the upper and lower substrates. The LCD devices make use of optical anisotropy of liquid crystal molecules to produce image data by varying light transmittance according to an arrangement of the liquid crystal molecules that are controlled by an electric field.

One substrate of the LCD device includes a thin film transistor that functions as a switching element. An LCD device that includes the thin film transistor is commonly referred to as an active matrix liquid crystal display (AM-LCD) device. The AMLCD device has high image resolution and can display moving images.

Amorphous silicon is commonly used as an active layer of a thin film transistor since amorphous silicon can be formed on large, low cost substrates, such as glass, under relatively low temperatures. However, although the LCD device is better than the CRT in power consumption, the LCD device including amorphous silicon is very expensive.

FIG. 1 is a schematic view of an LCD device according to the related art. In FIG. 1, gate and data driver ICs are connected to an array substrate, which includes an amorphous silicon TFT in a display area, using a tape automated bonding (TAB) method. The driver IC is a large scale integration (LSI) device and includes complementary metal-oxide-semiconductor (CMOS) devices that use single crystalline silicon as active layers. Accordingly, the driver IC is very costly.

In a high resolution LCD device, such as a super extended graphic array (SXGA), which has a resolution of 1280×1024, the LCD device requires a total of (1280×3)+1024 leads to connect the driver ICs to the array substrate. Accordingly, this decreases reliability and productivity of the LCD device. Additionally, this raises the cost of the LCD device.

Since devices that include active layers made of amorphous silicon are expensive to fabricate, LCD devices that include polycrystalline silicon as active layers of the TFTs have been developed. Accordingly, the number of fabrication steps can be reduced since the thin film transistors and driver IC can be formed on the same substrate, eliminating the need for TAB bonding.

FIG. 2 is a schematic view of another LCD device according to the related art. In FIG. 2, gate and data driver ICs are formed on an array substrate that includes polycrystalline silicon TFTs provided in a display area. The LCD device is commonly referred to as a chip on glass (COG) type device. In addition, field effect mobility of polycrystalline silicon is about 100 to 200 times greater than field effect mobility of amorphous silicon. Moreover, polycrystalline silicon is also optically and thermally stable.

FIG. 3 is a cross sectional view of a polycrystalline silicon TFT according to the related art. In FIG. 3, a buffer layer 11 is formed on a transparent substrate 10 and a polycrystalline silicon layer 12 is formed on the buffer layer 11. The polycrystalline silicon layer 12 includes an active layer 12*a* and source and drain regions 12*b* and 12*c*. A gate insulating layer 13 is formed on the polycrystalline silicon layer 12 and a gate electrode 14 is formed on the gate insulating layer 13, wherein the gate electrode 14 corresponds to the active layer 12*a*. An inter-insulating layer 15 covers the substrate 10 including the gate electrode 14, and the inter-insulating layer 15 has first and second contact holes 15*a* and 15*b*. The first and second contact holes 15*a* and 15*b* expose the source and drain regions 12*b* and 12*c*, respectively. Source and drain electrodes 16 and 17 are formed on the inter-insulating layer 15. The source and drain electrodes 16 and 17 are connected to the source and drain regions 12*b* and 12*c* through the first and second contact holes 15*a* and 15*b*, respectively. A passivation layer 18 is formed on the source and drain electrodes 16 and 17, and the passivation layer 18 has a third contact hole 18*a* exposing the drain electrode 17. A pixel electrode 19 is formed on the passivation layer 18, and is connected to the drain electrode 17 through the third contact hole 18*a*.

FIG. 4 is a perspective view of an LCD device including the polycrystalline silicon thin film transistor of FIG. 3 according to the related art. In FIG. 4, an LCD device includes lower and upper substrates 20 and 30, which are spaced apart and facing each other, and a liquid crystal material layer 40 disposed between the upper and lower substrates 30 and 20. A gate line 22 and a data line 24 are formed on an inside of the lower substrate 20 to cross each other, thereby defining a pixel region P. A thin film transistor T, which includes polycrystalline silicon as an active layer and has a structure of FIG. 3, is provided at the crossing of the gate line 22 and the data line 24. A pixel electrode 26 is formed within the pixel region P and is connected to the thin film transistor T.

In addition, a black matrix 32, which has an opening corresponding to the pixel electrode 26, is formed on an inside of the upper substrate 30. A color filter layer 34 that corresponds to the opening of the black matrix 32 is formed on the black matrix 32. The color filter layer 34 includes three color filters red (R), green (G), and blue (B), wherein each color corresponds to a respective pixel electrode 26. In addition, a common electrode 36 is formed on the color filter layer 34.

The lower substrate 20 including the thin film transistor T and the pixel electrode 26 may be commonly referred to as an array substrate, and the upper substrate 30 including the color filter layer 34 may be commonly referred to as a color filter substrate.

FIG. 5 is a schematic view of an equivalent circuit view for a pixel of the LCD device of FIG. 4 according to the related art. In FIG. 5, an equivalent circuit of a pixel of the LCD device of FIG. 4 includes a P-TFT interconnected between a data line and a gate line, wherein a signal transmitted along the gate line enables the P-TFT to transmit an image signal along the data line. Accordingly, a liquid crystal cell capacitance $C_{LC}$ of the liquid crystal cell, which is formed with the common line, and a storage capacitance $C_{STG}$, which is formed with the storage line, are formed when the P-TFT is enabled.

The array substrate and the color filter substrate are manufactured through various fabricating processes, respectively, and are subsequently assembled. The array substrate goes through various inspection processes before and after assembly, including a process to stabilize the polycrystalline silicon thin film transistor (TFT). Leakage current, which is commonly referred to as OFF-current, occurs due to the presence of electron carriers in a vicinity of the P-N junction of the polycrystalline silicon TFT when the polycrystalline silicon TFT is driven for a long period of time under normal operating temperatures. The leakage current causes residual images that lead to degradation of pixels of the LCD device. Therefore, a process for decreasing the OFF-current of the polycrystalline silicon TFT is required.

The OFF-current can be reduced by generating an OFF-stress at each junction region of the polycrystalline silicon TFT. For example, one method for reducing OFF-state current in field effect transistors is disclosed by Fonash et al. (U.S. Pat. No. 5,945,866). Direct current (DC) voltage or alternating current (AC) voltage may be used to generate the OFF-stress. However, since the LCD device includes storage capacitors, it is difficult to apply the DC voltage to the pixel TFTs.

SUMMARY OF THE INVENTION

Accordingly, the present invention is directed to a system and a method for reducing OFF-current in a thin film transistor of a liquid crystal display device that substantially obviates one or more problems due to limitations and disadvantages of the related art.

An object of the present invention is to provide a system and a method for reducing OFF-current in a thin film transistor of a liquid crystal display device that removes residual images and improves image quality.

Another object of the present invention is to provide a system and method for reducing OFF-current in a thin film transistor of a liquid crystal display device that gets rid of vertical crosstalk phenomenon.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a system for reducing an OFF-current in a thin film transistor of a liquid crystal display device includes gate and data lines crossing each other, a pixel thin film transistor including gate, and source and drain electrodes, the gate electrode connected to the gate line and the source electrode connected to the data line, a liquid crystal capacitor connected to the drain electrode of the pixel thin film transistor, a first switch thin film transistor connected to a first end of the data line, a second switch thin film transistor connected to a first end of the gate line, a first voltage source electrically connected to the drain electrode of the pixel thin film transistor, a second voltage source connected to a source electrode of the first switch thin film transistor, a third voltage source connected to gate electrodes of the first and second switch thin film transistors, and a fourth voltage source connected to a source electrode of the second switch thin film transistor.

In another aspect, a system for reducing an OFF-current in a thin film transistor of a liquid crystal display device includes gate and data lines crossing each other, a pixel thin film transistor including gate, source and drain electrodes, the gate electrode connected to the gate line and the source electrode connected to the data line, a liquid crystal capacitor connected to the drain electrode of the pixel thin film transistor, a first switch thin film transistor connected to a first end of the data line, a second switch thin film transistor connected to a first end of the gate line, a first voltage source electrically connected to the drain electrode of the pixel thin film transistor, a second voltage source connected to a source electrode of the first switch thin film transistor, a third voltage source connected to a gate electrode of the first switch thin film transistor, a fourth voltage source connected to a source electrode of the second switch thin film transistor, a fifth voltage source connected to a gate electrode of the second switch thin film transistor, a multiplexing thin film transistor connected to a second end of the data line, a gate driver integrated circuit (IC) connected to a second end of the gate line, and a data driver integrated circuit (IC) connected to the multiplexing thin film transistor, wherein the data driver IC includes a data driver voltage source and a multiplexing circuit signal source such that the data driver voltage source is connected to a source electrode of the multiplexing thin film transistor and the multiplexing circuit signal source is connected to a gate electrode of the multiplexing thin film transistor.

In another aspect, a system for reducing an OFF-current in a thin film transistor of a liquid crystal display device includes gate and data lines crossing each other, a pixel thin film transistor including gate, source and drain electrodes, the gate electrode connected to the gate line and the source electrode connected to the data line, a liquid crystal capacitor connected to the drain electrode of the pixel thin film transistor, a switch thin film transistor connected to a first end of the gate line, a first voltage source electrically connected to the drain electrode of the pixel thin film transistor, a second voltage source connected to a source electrode of the switch thin film transistor, a third voltage source connected to a gate electrode of the switch thin film transistor, a multiplexing thin film transistor connected to an end of the data line, a first gate driver integrated circuit (IC) connected to the source electrode of the switch thin film transistor, and a data driver integrated circuit (IC) connected to the multiplexing thin film transistor, wherein the data driver IC includes a data driver voltage source and a multiplexing circuit signal source such that the data driver voltage source is connected to a source electrode of the multiplexing thin film transistor and the multiplexing circuit signal source is connected to a gate electrode of the multiplexing thin film transistor.

In another aspect, a method for reducing an OFF-current in a thin film transistor of a liquid crystal display device, the liquid crystal display device including gate and data lines crossing each other, a pixel thin film transistor including gate, source and drain electrodes, the gate electrode connected to the gate line and the source electrode connected to the data line, a liquid crystal capacitor connected to the drain electrode of the pixel thin film transistor, a first switch thin film transistor connected to a first end of the data line, and a second switch thin film transistor connected to a first end of the gate line, includes supplying a first direct current (DC) voltage to gate electrodes of the first and second switch thin film transistors, thereby turning the first and second switch thin film transistors ON, supplying a second DC voltage to the source electrode of the pixel thin film transistor through the first switch thin film transistor, supplying a third DC voltage to the gate electrode of the pixel thin film transistor through the second switch thin film transistor to turn the pixel thin film transistor OFF, and supplying an alternating current (AC) voltage to the drain electrode of the pixel thin film transistor.

In another aspect, a method for reducing an OFF-current in a thin film transistor of a liquid crystal display device, the liquid crystal display device including gate and data lines crossing each other, a pixel thin film transistor including gate, source and drain electrodes, the gate electrode connected to the gate line and the source electrode connected to the data line, a liquid crystal capacitor connected to the drain electrode of the pixel thin film transistor, a first switch thin film transistor connected to a first end of the data line, a second switch thin film transistor connected to a first end of the gate line, a multiplexing thin film transistor connected to a second end of the data line, a gate driver integrated circuit (IC) connected to a second end of the gate line, and a data driver integrated circuit (IC) connected to the multiplexing thin film transistor, includes supplying a first direct current (DC) voltage to a gate electrode of the first switch thin film transistor to turn the first switch thin film transistor OFF, supplying a second DC voltage to a gate electrode of the multiplexing thin film transistor to turn the multiplexing thin film transistor ON, supplying a third DC voltage to the source electrode of the pixel thin film transistor through the multiplexing thin film transistor, supplying a fourth DC voltage to a gate electrode of the second switch thin film transistor to turn the second switch thin film transistor ON, supplying a fifth DC voltage to the gate electrode of the pixel thin film transistor through the second switch thin film transistor to turn the pixel thin film transistor OFF, and supplying an alternating current (AC) voltage to the drain electrode of the pixel thin film transistor.

In another aspect, a method for reducing an OFF-current in a thin film transistor of a liquid crystal display device, the liquid crystal display device including gate and data lines crossing each other, a pixel thin film transistor including gate, source and drain electrodes, the gate electrode connected to the gate line and the source electrode connected to the data line, a liquid crystal capacitor connected to the drain electrode of the pixel thin film transistor, a switch thin film transistor connected to a first end of the gate line, a multiplexing thin film transistor connected to an end of the data line, a first gate driver integrated circuit (IC) connected to a source electrode of the switch thin film transistor, and a data driver integrated circuit (IC) connected to the multiplexing thin film transistor, includes supplying a first direct current (DC) voltage to a gate electrode of the multiplexing thin film transistor to turn the multiplexing thin film transistor ON, supplying a second DC voltage to the source electrode of the pixel electrode through the multiplexing thin film transistor, supplying a third DC voltage to a gate electrode of the switch thin film transistor to turn the switch thin film transistor ON, supplying a fourth DC voltage to the gate electrode of the pixel thin film transistor through the switch thin film transistor to turn the pixel thin film transistor OFF, and supplying an alternating current (AC) voltage to the drain electrode of the pixel thin film transistor.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
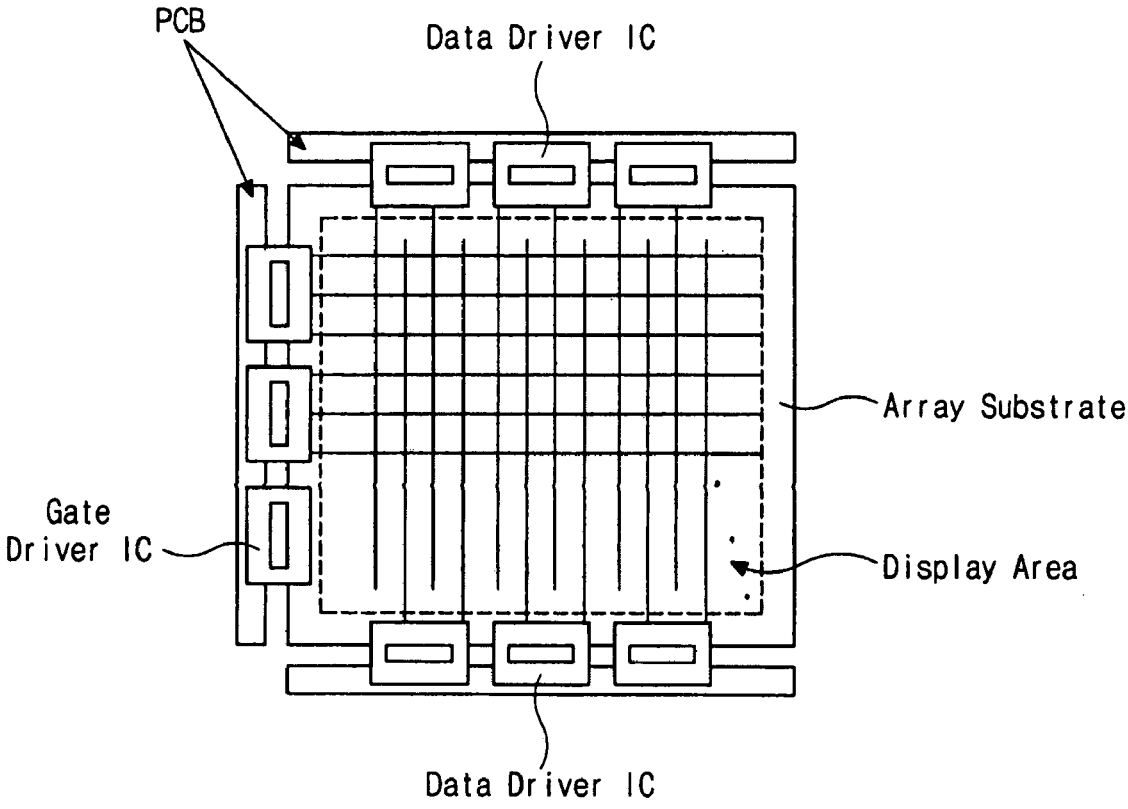
FIG. 1 Related Art
FIG. 1 is a schematic view of an LCD device according to the related art.
Figure 2:
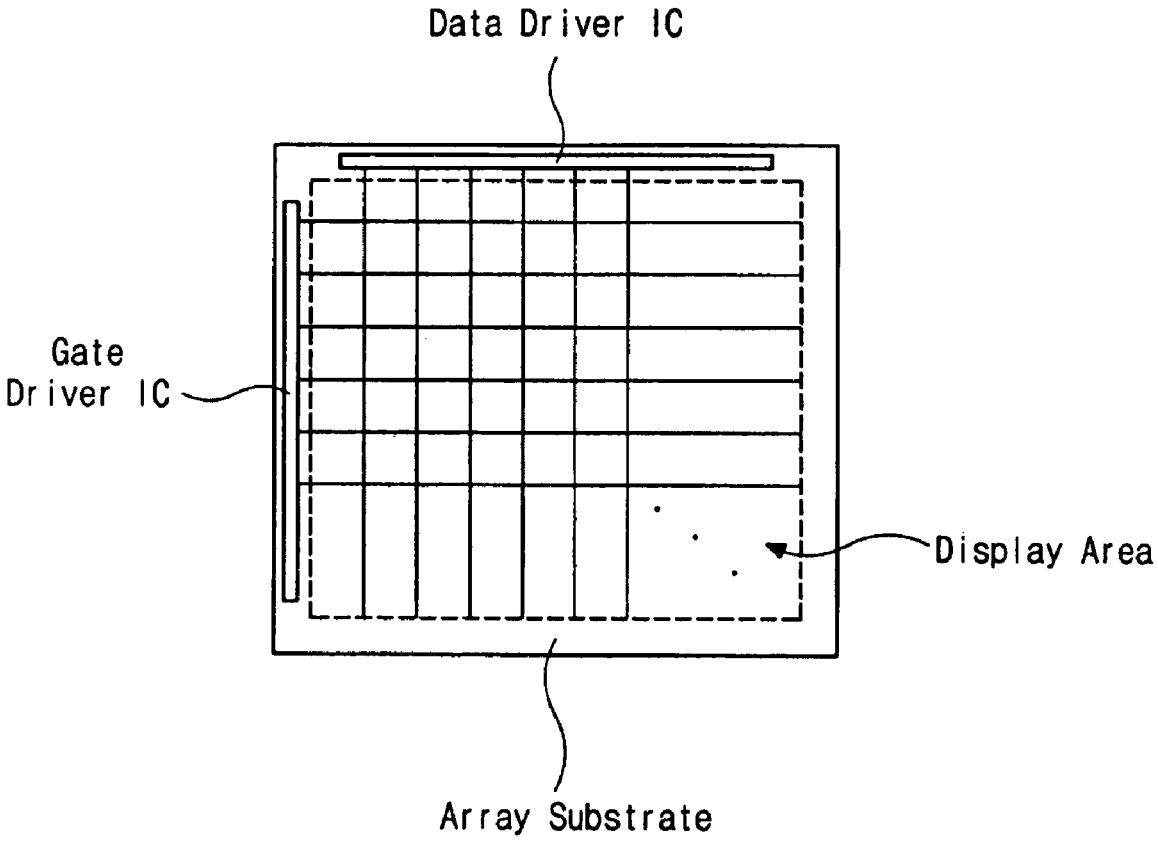
FIG. 2 Related Art
FIG. 2 is a schematic view of another LCD device according to the related art.
Figure 3:
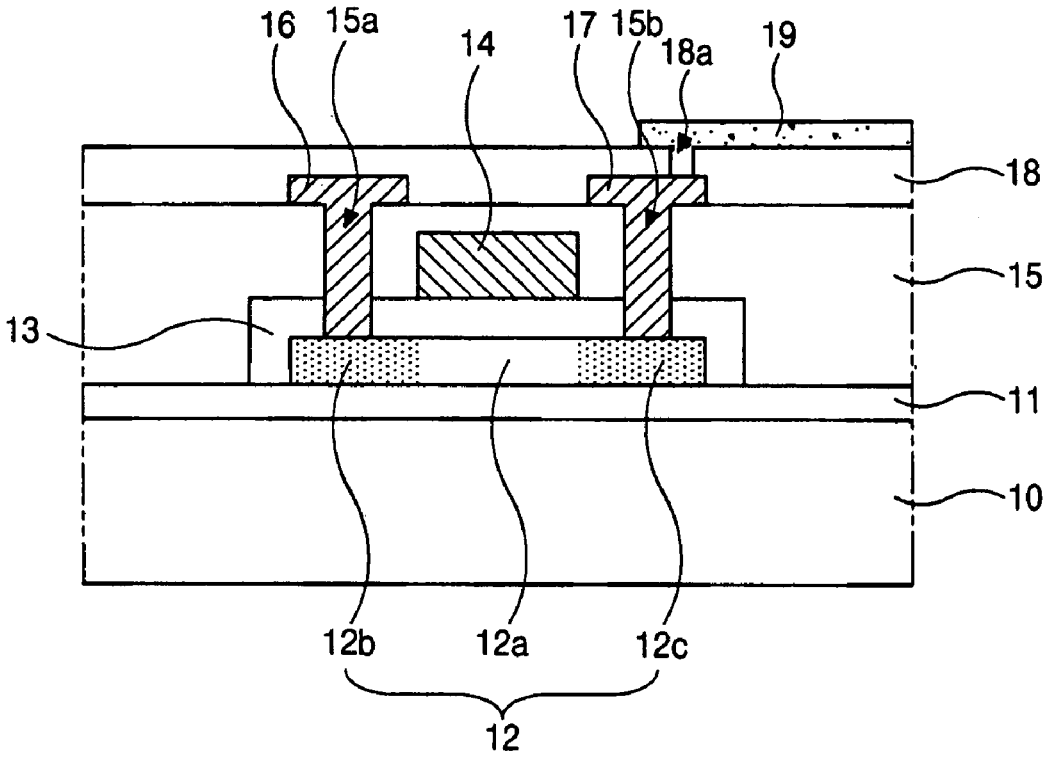
FIG. 3 Related Art
FIG. 3 is a cross sectional view of a polycrystalline silicon TFT according to the related art.
Figure 4:
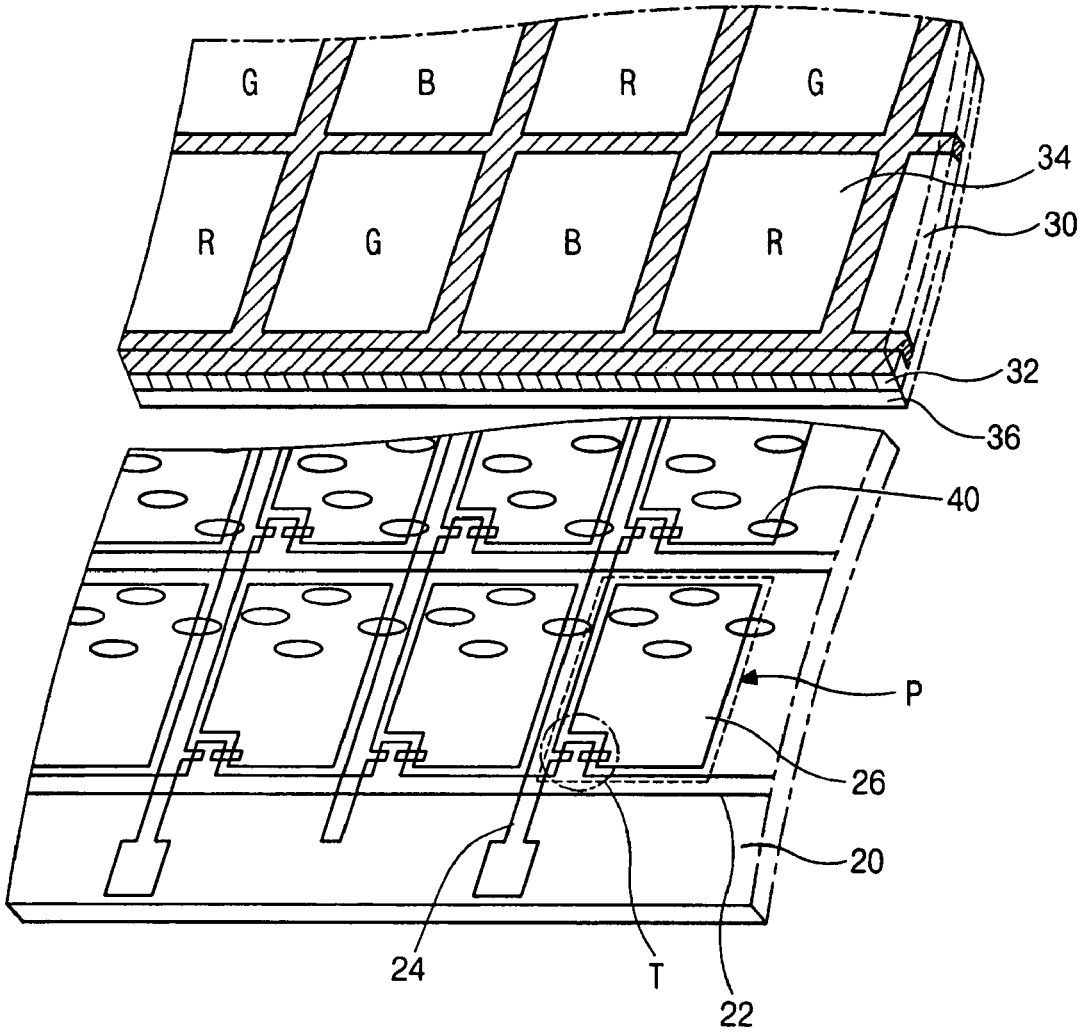
FIG. 4 Related Art
FIG. 4 is a perspective view of an LCD device including the polycrystalline silicon thin film transistor of FIG. 3 according to the related art.
Figure 5:
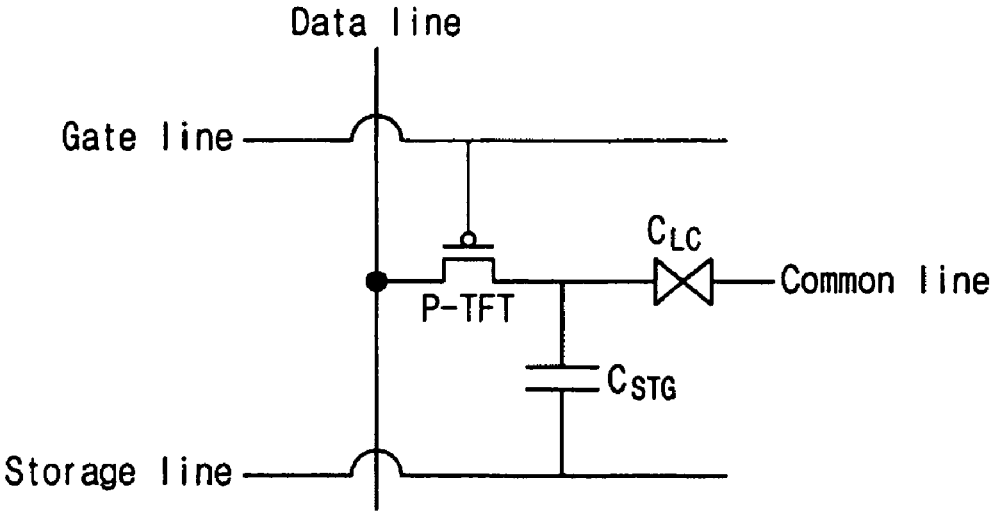
FIG. 5 Related Art
FIG. 5 is a schematic view of an equivalent circuit view for a pixel of the LCD device of FIG. 4 according to the related art.
Figure 6:
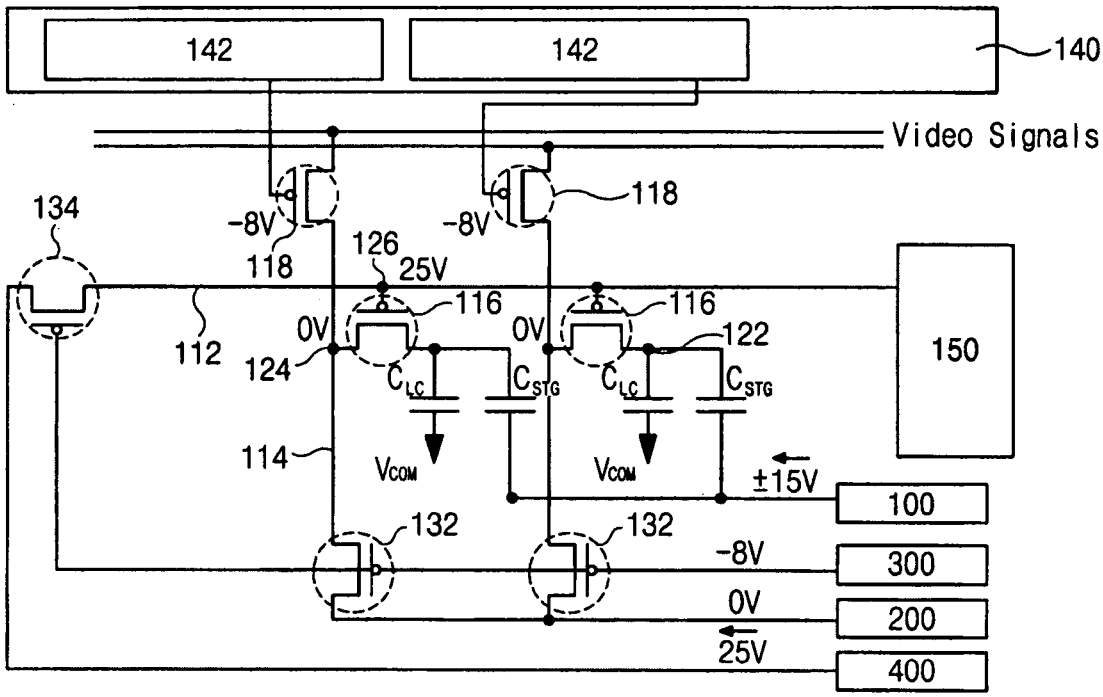
FIG. 6 is an exemplary schematic view of a liquid crystal display (LCD) device according to the present invention.

FIG. 6 is an exemplary schematic view of a liquid crystal display (LCD) device according to the present invention. In FIG. 6, a gate line 112 and a data line 114 cross each other to define a pixel region, wherein a pixel thin film transistor (TFT) 116 may be formed. A gate electrode of the pixel TFT 116 may be connected to the gate line 112 and a source electrode of the pixel TFT 116 may be connected to the data line 114. A liquid crystal (LC) capacitor $C_{LC}$ may be connected to a drain electrode of the pixel TFT 116 and a common electrode $V_{COM}$. One electrode of a storage capacitor $C_{STG}$ may be also connected to the drain electrode of the pixel TFT 116, wherein the storage capacitor $C_{STG}$ may be in parallel to the LC capacitor $C_{LC}$. Accordingly, the storage capacitor $C_{STG}$ and the LC capacitor $C_{LC}$ may form a first node 122. The other electrode of the storage capacitor $C_{STG}$ may be connected to a first voltage source 100.

A pass-gate TFT 118 may be formed between the data line 114 and a data driver integrated circuit (IC) 140, wherein a drain electrode of the pass-gate TFT 118 may be connected to one end of the data line 114. In addition, a gate electrode of the pass-gate TFT 118 may be connected to an output terminal (not shown) of a shift register 142, which may be included in the data driver IC 140, and a source electrode of the pass-gate TFT 118 may be connected to a video signal line supplying the data line with video signals. The pass-gate TFT 118 turns ON due to data clocks from the shift register 142, and video signals from the video signal line are supplied to the source electrode of the pixel TFT 116 through the pass-gate TFT 118 and the data line 114.

The data line 114 and the source electrode of the pixel TFT 116 may form a second node 124, wherein a drain electrode of a first switch TFT 132 may be connected to the other end of the data line 114 and a gate electrode and a source electrode of the first switch TFT 132 may be connected to a second voltage source 200 and a third voltage source 300, respectively.

The gate line 112 and the gate electrode of the pixel TFT 116 may form a third node 126, wherein one end of the gate line 112 may be connected to an output terminal of a gate driver IC 150, and the other end of the gate line 112 may be connected to a source electrode of a second switch TFT 134. In addition, a gate electrode of the second switch TFT 134 may be connected to the third voltage source 300, and a drain electrode of the second switch TFT 134 may be connected to a fourth voltage source 400.

The first voltage source 100 may be an AC voltage source, and the second to fourth voltage sources 200, 300, and 400 may be DC voltage sources. The first to fourth voltage sources 100, 200, 300, and 400 and the switch TFTs 132 and 134 may formed on a separate substrate, and the substrate may be attached to an LC panel including the pixel TFT 116, the LC capacitor $C_{LC}$, and the storage capacitor $C_{STG}$ by using a method including TAB, TCP, and FPC.

The pixel TFT 116, the pass-gate TFT 118, the first switch TFT 132, and the second switch TFT 134 may include p-type polycrystalline silicon as an active layer. Alternatively, the TFTs 116, 118, 132 and 134 may include n-type polycrystalline silicon as the active layer.

A method supplying OFF-stress to the pixel TFT of the LCD device according to the present invention will be explained hereinafter. In FIG. 6, in order to provide an OFF-stress to the pixel TFT 116, voltages may be supplied to the gate and source electrodes of the pixel TFT 116, wherein the pixel TFT 116 may be driven. Accordingly, the first switch TFT 132, the second switch TFT 134, and the first to fourth voltage sources 100, 200, 300, and 400 may be formed on a separate substrate from an LC panel of the LCD device.

The first voltage source 100 may provide ±15V, the second voltage source 200 may provide 0V, the third voltage source 300 may provide −8V, and the fourth voltage source 400 may provide 25V. The voltage from the third voltage source 300 may be supplied to the gate electrode of the first switch TFT 132, whereby the first switch TFT 132 turns ON. The voltage from the second voltage source 200 may be supplied to the second node 124 through the first switch TFT 132 and the data line 114. The second switch TFT 134 turns ON due to the voltage from the third voltage source 300, and the fourth voltage source 400 may be supplied to the third node 126 through the second switch TFT 134 and the gate line 112. The voltage from the first voltage source 100 may be supplied to the first node 122 through the storage capacitor $C_{STG}$. Accordingly, the gate and source and drain electrodes of the pixel TFT 116 have values of 25V, 0V, and ±15V, respectively. When the drain electrode receive +15V, the voltage difference between the gate and source electrodes of the pixel TFT 116 is larger than the voltage difference between the gate and drain electrodes. Thus, an OFF-stress is provide to a region adjacent to the source electrode of the pixel TFT 116. In addition, when the drain electrode receives −15V, the voltage difference between the gate and drain electrodes of the pixel TFT 116 is larger than the voltage difference between the gate and source electrodes. Thus, an OFF-stress may be provided to a region adjacent the drain electrode of the pixel TFT 116.

Figure 7:
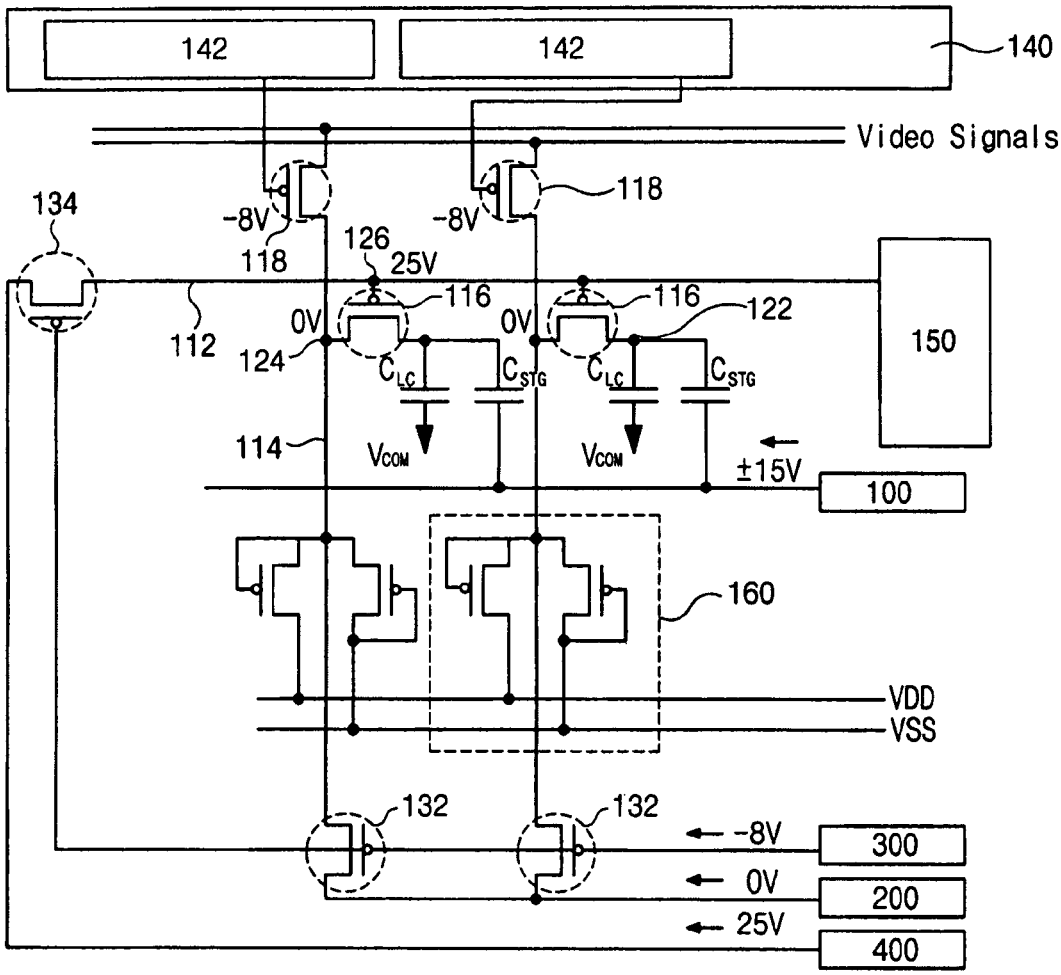
FIG. 7 is another exemplary schematic view of an LCD device according to the present invention.

FIG. 7 is another exemplary schematic view for an LCD device according to the present invention. Although the LCD device of FIG. 7 has a structure similar to the structure shown in FIG. 6, the LCD device of FIG. 7 further includes an electrostatic discharge (ESD) protection circuit 160. Accordingly, a method supplying an OFF-stress to a pixel TFT may be similar to the method of supplying an OFF-stress to the pixel TFT in FIG. 6.

Figure 8:
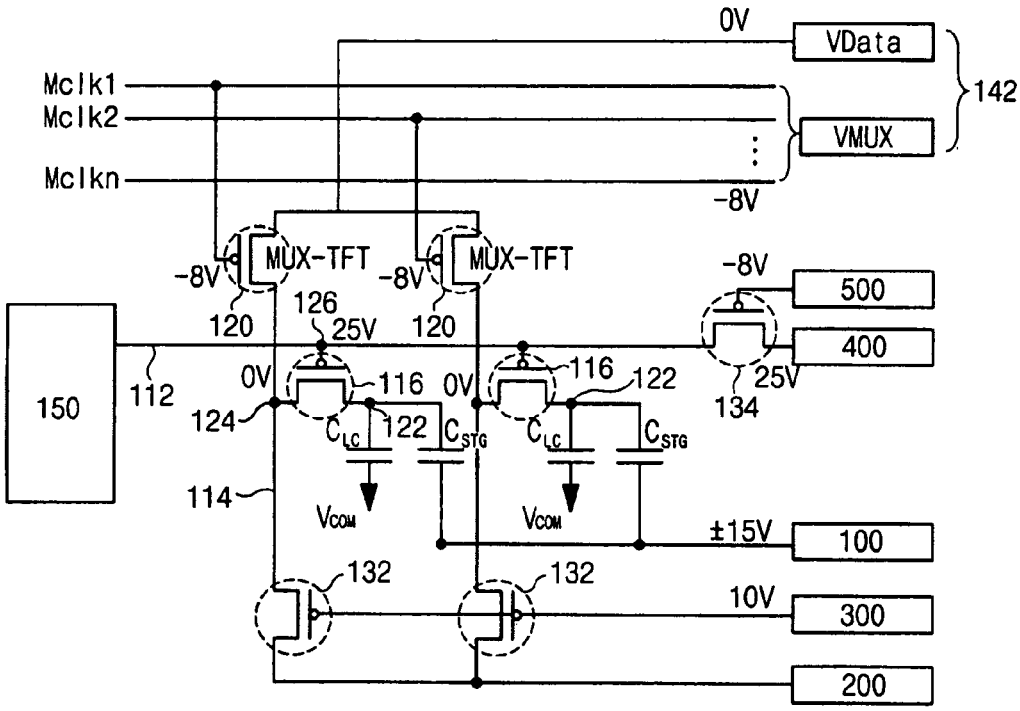
FIG. 8 is another exemplary schematic view of an LCD device according to the present invention.

FIG. 8 is another exemplary schematic view of an LCD device according to the present invention. In FIG. 8, an LCD device may include a data driver IC having an analog sampling circuit within. The LCD device of FIG. 8 may have a structure similar to the LCD device structure of FIG. 6, wherein the same references of FIG. 6 are used in FIG. 8.

In FIG. 8, a multiplexing (MUX) TFT 120 may be formed between a data driver IC 142 and a data line 114, wherein a drain electrode of the MUX TFT 120 may be connected to one end of the data line 114, and a source electrode of a pixel TFT 116 may be connected to the data line 114. In addition, a source electrode of the MUX TFT 120 may be connected to a data driver supplying voltage source VData in the data driver IC 142, and a gate electrode of the MUX TFT 120 may be connected to a MUX circuit signal source VMUX in the data driver IC 142.

A drain electrode of the pixel TFT 116 may be connected to an LC capacitor $C_{LC}$ and a storage capacitor $C_{STG}$, that are connected in parallel. The LC capacitor $C_{LC}$ and the storage capacitor $C_{STG}$ may form a first node 122, wherein the LC capacitor $C_{LC}$ may be connected to a common electrode $V_{COM}$ and the storage capacitor $C_{STG}$ may be connected to a first voltage source 100.

A second node 124 may be formed from a crossing of the data line 114 and the source electrode of the pixel TFT 116. A drain electrode of a first switch TFT 132 may be connected to the other end of the data line 114 so the drain electrode of the first switch TFT 132 may be electrically connected to the second node 124. In addition, a source electrode of the first switch TFT 132 may be connected to a second voltage source 200, and a gate electrode of the first switch TFT 132 may be connected to a third voltage source 300.

A gate electrode of the pixel TFT 116 may be connected to a gate line 112, which crosses the data line 114, wherein the gate line 112 and the gate electrode of the pixel TFT 116 may form a third node 126. In addition, a drain electrode of a second switch TFT 134 may be electrically connected to the third node 126 through the gate line 112, a source electrode of the second switch TFT 134 may be connected to a fourth voltage source 400, and a gate electrode of the second switch TFT 134 may be connected to a fifth voltage source 500.

The pixel TFT 116, the pass-gate TFT 118, the first switch TFT 132, and the second switch TFT 134 may include p-type polycrystalline silicon as an active layer. Alternatively, n-type polycrystalline silicon may be used as the active layer.

A method for supplying OFF-stress to the pixel TFT will now be explained according to FIG. 8. First, in order to not use the first switch TFT 132, the switch TFT 132 turns OFF by supplying 10V to the gate electrode of the first switch TFT 132 from the third voltage source 300. Then, a signal of about −8V may be supplied to the gate electrode of the second switch TFT 134 from the fifth voltage source 500, and a signal of about 25V may be supplied to the source electrode of the second switch TFT 134 from the fourth voltage source 400. Next, the second switch TFT 132 may turn ON, and a signal of about 25V may be supplied to the gate electrode of the pixel TFT 116 through the second switch TFT 132 and the gate line 112.

From the MUX circuit signal source VMUX, a signal of about −8V may be supplied to the gate electrode of the MUX TFT 120, wherein the MUX TFT 120 turns ON. Accordingly, a signal of about 0V from the data driver supplying voltage source VData may be supplied to the source electrode of the pixel TFT 116 through the MUX TFT 120 and the data line 114. In addition, an AC voltage of about ±15V may be supplied to the drain electrode of the pixel TFT 116 from the first voltage source 100. Accordingly, an OFF-stress may be supplied to the pixel TFT 116.

Figure 9:
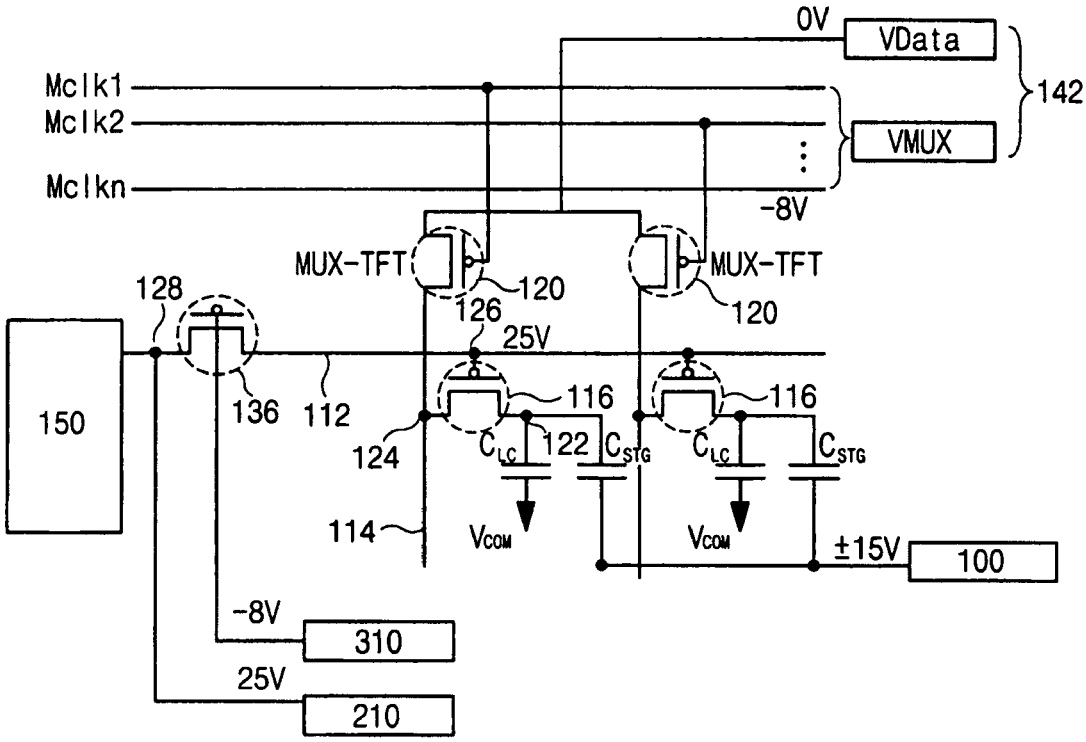
FIG. 9 is another exemplary schematic view of an LCD device according to the present invention.

FIG. 9 is another exemplary schematic view of an LCD device according to the present invention. In FIG. 9, a gate line 112 and a data line 114 may cross each other, and a pixel TFT 116 may be provided at the crossing. A gate electrode of the pixel TFT 116 may be connected to the gate line 112, a source electrode of the pixel TFT 116 may be connected to the data line 114, and a drain electrode of the pixel TFT 116 may be connected to an LC capacitor $C_{LC}$ and a storage capacitor $C_{STG}$, wherein the LC capacitor $C_{LC}$ and the storage capacitor $C_{STG}$ may be formed in parallel with each other. A first node 122 may be formed from interconnection of the drain electrode of the pixel TFT 116, the LC capacitor $C_{LC}$, and the storage capacitor $C_{STG}$. In addition, the LC capacitor $C_{LC}$ may be connected to a common electrode $V_{COM}$, and the storage capacitor $C_{STG}$ may be connected to a first voltage source 100. Moreover, a switch TFT 136 may be formed between a gate driver IC 150 and the gate line 112, wherein a source electrode of the switch TFT 136 may be connected to an output terminal of the gate driver IC 150, and a drain electrode of the switch TFT 136 may be connected to the gate line 112. Accordingly, the source electrode of the switch TFT 136 may form a second node 128 by contacting the output terminal of the gate driver IC 150, wherein the second node 128, i.e., the source electrode of the switch TFT 136, may be connected to a second voltage source 210. In addition, a gate electrode of the switch TFT 136 may be connected to a third voltage source 310.

A MUX TFT 120 may be formed between a data driver IC 142 and the data line 114, wherein a drain electrode of the MUX TFT 120 may be connected to one end of the data line 114, a source electrode of the MUX TFT 120 may be connected to a data driver supplying voltage source VData in the data driver IC 142, and a gate electrode of the MUX TFT 120 may be connected to a MUX circuit signal source VMUX in the data driver IC 142. The first, second, and third voltage sources 100, 210, and 310 may provide signals of about ±15V, 25V, and −8V, respectively. In addition, a signal of about −8V from the MUX circuit signal source VMUX may be supplied to the gate electrode of the MUX TFT 120, and a signal of about 0V from the data driver supplying voltage source VData may be supplied to the source electrode of the MUX TFT 120.

The switch TFT 136 may be turned ON by the voltage from the third voltage source 310, and a signal of about 25V from the second voltage source 210 may be supplied to the gate electrode of the pixel TFT 116 through the switch TFT 136 and the gate line 112. The MUX TFT 120 may be turned ON by the signal −8V from the MUX circuit signal source VMUX, and a signal of about 0V from the data driver supplying voltage source VData may be supplied to the source electrode of the pixel TFT 116 through the MUX TFT 120 and the data line 114. In addition, an AC voltage of about ±15V from the first voltage source 100 may be supplied to the drain electrode of the switch TFT 116 through the storage capacitor $C_{STG}$. Accordingly, an OFF stress may be supplied to the pixel TFT 116.

Figure 10:
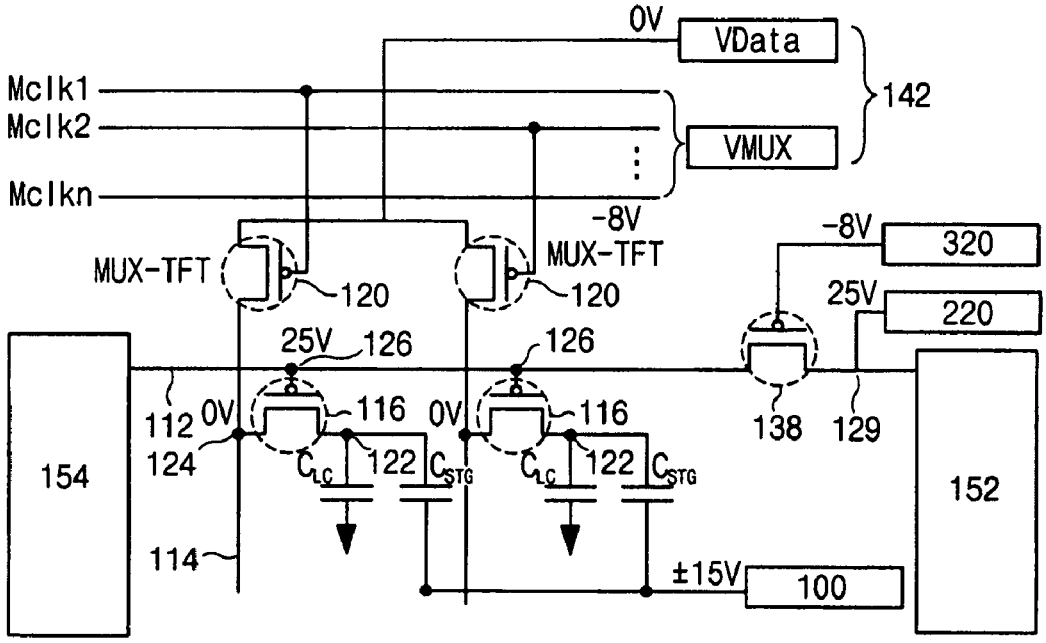
FIG. 10 is another exemplary schematic view of an LCD device according to the present invention.

FIG. 10 is another exemplary schematic view for an LCD device according to the present invention. The schematic view of FIG. 10 may be similar to the schematic view of FIG. 9, wherein the same references will not be explained. In FIG. 10, the schematic view may include first and second gate driver ICs 152 and 154, each of which may be connected to each end of the gate line 112. In addition, a switch TFT 138 may be formed between the gate line 112 and the first gate driver IC 152, wherein a source electrode of the switch TFT 138 may be connected to an output terminal of the first gate driver IC 152. The source electrode of the switch TFT 138 may also be connected to a second voltage source 220, and a gate electrode of the switch TFT 138 may be connected to a third voltage source 320. The second and third voltage sources 220 and 320 may supply signals of about 25V and about −8V to the switch TFT 138, respectively.

In FIG. 10, a method for supplying an OFF-stress to the pixel TFT 116 may be similar to the method of FIG. 9, whereby detailed explanation of the method has been omitted.

In addition, the voltage sources may be formed on an array substrate of an LC panel, or the voltage sources may be formed on a separate substrate from the LC panel of the LCD device and may be connected to the LC panel by using tape carrier package (TCP) or flexible printed circuit (FPC). In the present invention, an OFF-current may be reduced by generating an OFF-stress within each junction region of the polycrystalline silicon TFT by an AC voltage. Accordingly, a process for the method may be accomplished even during an inspection process of a backlight device, and the present invention may not require additional apparatuses or extra process steps.

It will be apparent to those skilled in the art that various modifications and variations can be made in the liquid crystal display device and the method of fabricating the same of the present invention without departing from the spirit or scope of the invention. Thus, it is intended that the present invention cover the modifications and variations of this invention provided they come within the scope of the appended claims and their equivalents.

What is claimed is:

1. A system for reducing an OFF-current in a thin film transistor of a liquid crystal display device, comprising:

gate and data lines crossing each other;

a pixel thin film transistor including gate, source and drain electrodes, the gate electrode connected to the gate line and the source electrode connected to the data line;

a liquid crystal capacitor connected to the drain electrode of the pixel thin film transistor;

a first switch thin film transistor connected to a first end of the data line;

a second switch thin film transistor connected to a first end of the gate line;

a first voltage source electrically connected to the drain electrode of the pixel thin film transistor;

a second voltage source connected to a source electrode of the first switch thin film transistor;

a third voltage source connected to gate electrodes of the first and second switch thin film transistors; and a fourth voltage source connected to a source electrode of the second switch thin film transistor.

2. The system according to claim 1, wherein the first voltage source supplies alternating current (AC) voltage to the drain electrode of the pixel thin film transistor.

3. The system according to claim 2, wherein the second, third, and fourth voltage sources supply direct current (DC) voltages.

4. The system according to claim 1, further comprising a storage capacitor between the drain electrode of the pixel thin film transistor and the first voltage source.

5. The system according to claim 1, further comprising an electrostatic discharge (ESD) protection circuit between the first switch thin film transistor and the data line.

6. The system according to claim 1, wherein the pixel thin film transistor and the first and second switch thin film transistors include p-type polycrystalline silicon as active layers.

7. The system according to claim 1, further comprising a gate driver integrated circuit (IC) connected to a second end of the gate line and a data driver integrated circuit (IC) electrically connected to a second end of the data line.

8. The system according to claim 7, further comprising a pass-gate thin film transistor between the data line and the data driver IC.

9. The system according to claim 1, wherein the first to fourth voltage sources are connected to a liquid crystal panel including the pixel thin film transistor and the liquid crystal capacitor by using one of tape carrier package (TCP) and flexible printed circuit (FPC).

10. A system for reducing an OFF-current in a thin film transistor of a liquid crystal display device, comprising:

gate and data lines crossing each other;

a pixel thin film transistor including gate, source and drain electrodes, the gate electrode connected to the gate line and the source electrode connected to the data line;

a liquid crystal capacitor connected to the drain electrode of the pixel thin film transistor;

a first switch thin film transistor connected to a first end of the data line;

a second switch thin film transistor connected to a first end of the gate line;

a first voltage source electrically connected to the drain electrode of the pixel thin film transistor;

a second voltage source connected to a source electrode of the first switch thin film transistor;

a third voltage source connected to a gate electrode of the first switch thin film transistor;

a fourth voltage source connected to a source electrode of the second switch thin film transistor;

a fifth voltage source connected to a gate electrode of the second switch thin film transistor;

a multiplexing thin film transistor connected to a second end of the data line;

a gate driver integrated circuit (IC) connected to a second end of the gate line; and a data driver integrated circuit (IC) connected to the multiplexing thin film transistor, wherein the data driver IC includes a data driver voltage source and a multiplexing circuit signal source such that the data driver voltage source is connected to a source electrode of the multiplexing thin film transistor and the multiplexing circuit signal source is connected to a gate electrode of the multiplexing thin film transistor.

11. The system according to claim 10, wherein the first voltage source supplies alternating current (AC) voltage to the drain electrode of the pixel thin film transistor.

12. The system according to claim 11, wherein the second, third, fourth, and fifth voltage sources supply direct current (DC) voltages.

13. The system according to claim 10, further comprising a storage capacitor between the drain electrode of the pixel thin film transistor and the first voltage source.

14. The system according to claim 10, wherein the pixel thin film transistor and the first and second thin film transistors include p-type polycrystalline silicon as active layers.

15. A system for reducing an OFF-current in a thin film transistor of a liquid crystal display device, comprising:

gate and data lines crossing each other;

a pixel thin film transistor including gate, source and drain electrodes, the gate electrode connected to the gate line and the source electrode connected to the data line;

a liquid crystal capacitor connected to the drain electrode of the pixel thin film transistor;

a switch thin film transistor connected to a first end of the gate line;

a first voltage source electrically connected to the drain electrode of the pixel thin film transistor;

a second voltage source connected to a source electrode of the switch thin film transistor;

a third voltage source connected to a gate electrode of the switch thin film transistor;

a multiplexing thin film transistor connected to an end of the data line;

a first gate driver integrated circuit (IC) connected to the source electrode of the switch thin film transistor; and a data driver integrated circuit (IC) connected to the multiplexing thin film transistor, wherein the data driver IC includes a data driver voltage source and a multiplexing circuit signal source such that the data driver voltage source is connected to a source electrode of the multiplexing thin film transistor and the multiplexing circuit signal source is connected to a gate electrode of the multiplexing thin film transistor.

16. The system according to claim 15, wherein the first voltage source supplies alternating current (AC) voltage to the drain electrode of the pixel thin film transistor.

17. The system according to claim 16, wherein the second and third voltage sources supply direct current (DC) voltages.

18. The system according to claim 15, further comprising a storage capacitor between the drain electrode of the pixel thin film transistor and the first voltage source.

19. The system according to claim 15, further comprising a second gate driver IC connected to a second end of the gate line.

20. The system according to claim 15, wherein the pixel thin film transistor and the switch thin film transistor include p-type polycrystalline silicon as active layers.

21. A method for reducing an OFF-current in a thin film transistor of a liquid crystal display device, the liquid crystal display device including gate and data lines crossing each other, a pixel thin film transistor including gate, source and drain electrodes, the gate electrode connected to the gate line and the source electrode connected to the data line, a liquid crystal capacitor connected to the drain electrode of the pixel thin film transistor, a first switch thin film transistor connected to a first end of the data line, and a second switch thin film transistor connected to a first end of the gate line, comprising the steps of:

supplying a first direct current (DC) voltage to gate electrodes of the first and second switch thin film transistors, thereby turning the first and second switch thin film transistors ON;

supplying a second DC voltage to the source electrode of the pixel thin film transistor through the first switch thin film transistor;

supplying a third DC voltage to the gate electrode of the pixel thin film transistor through the second switch thin film transistor to turn the pixel thin film transistor OFF; and supplying an alternating current (AC) voltage to the drain electrode of the pixel thin film transistor.

22. The method according to claim 21, wherein the first DC voltage is about −8V.

23. The method according to claim 22, wherein the second DC voltage is about 0V.

24. The method according to claim 23, wherein the third DC voltage is about 25V.

25. The method according to claim 24, wherein the AC voltage has a maximum value of about +15V and a minimum value of about −15V.

26. A method for reducing an OFF-current in a thin film transistor of a liquid crystal display device, the liquid crystal display device including gate and data lines crossing each other, a pixel thin film transistor including gate, source and drain electrodes, the gate electrode connected to the gate line and the source electrode connected to the data line, a liquid crystal capacitor connected to the drain electrode of the pixel thin film transistor, a first switch thin film transistor connected to a first end of the data line, a second switch thin film transistor connected to a first end of the gate line, a multiplexing thin film transistor connected to a second end of the data line, a gate driver integrated circuit (IC) connected to a second end of the gate line, and a data driver integrated circuit (IC) connected to the multiplexing thin film transistor, comprising the steps of:

supplying a first direct current (DC) voltage to a gate electrode of the first switch thin film transistor to turn the first switch thin film transistor OFF;

supplying a second DC voltage to a gate electrode of the multiplexing thin film transistor to turn the multiplexing thin film transistor ON;

supplying a third DC voltage to the source electrode of the pixel thin film transistor through the multiplexing thin film transistor;

supplying a fourth DC voltage to a gate electrode of the second switch thin film transistor to turn the second switch thin film transistor ON;

supplying a fifth DC voltage to the gate electrode of the pixel thin film transistor through the second switch thin film transistor to turn the pixel thin film transistor OFF; and supplying an alternating current (AC) voltage to the drain electrode of the pixel thin film transistor.

27. The method according to claim 26, wherein the first DC voltage is about 10V.

28. The method according to claim 27, wherein the second DC voltage is about −8V.

29. The method according to claim 28, wherein the third DC voltage is about 0V.

30. The method according to claim 29, wherein the fourth DC voltage is about −8V.

31. The method according to claim 30, wherein the fifth DC voltage is about 25V.

32. The method according to claim 31, wherein the AC voltage has a maximum value of about +15V and a minimum value of about −15V.

33. A method for reducing an OFF-current in a thin film transistor of a liquid crystal display device, the liquid crystal display device including gate and data lines crossing each other, a pixel thin film transistor including gate, source and drain electrodes, the gate electrode connected to the gate line and the source electrode connected to the data line, a liquid crystal capacitor connected to the drain electrode of the pixel thin film transistor, a switch thin film transistor connected to a first end of the gate line, a multiplexing thin film transistor connected to an end of the data line, a first gate driver integrated circuit (IC) connected to a source electrode of the switch thin film transistor, and a data driver integrated circuit (IC) connected to the multiplexing thin film transistor, comprising the steps of:

supplying a first direct current (DC) voltage to a gate electrode of the multiplexing thin film transistor to turn the multiplexing thin film transistor ON;

supplying a second DC voltage to the source electrode of the pixel electrode through the multiplexing thin film transistor;

supplying a third DC voltage to a gate electrode of the switch thin film transistor to turn the switch thin film transistor ON;

supplying a fourth DC voltage to the gate electrode of the pixel thin film transistor through the switch thin film transistor to turn the pixel thin film transistor OFF; and supplying an alternating current (AC) voltage to the drain electrode of the pixel thin film transistor.

34. The method according to claim 33, wherein the liquid crystal display device further includes a second gate driver IC connected to a second end of the gate line.

35. The method according to claim 34, wherein the first DC voltage is about −8V.

36. The method according to claim 35, wherein the second DC voltage is about 0V.

37. The method according to claim 36, wherein the third DC voltage is about −8V.

38. The method according to claim 37, wherein the fourth DC voltage is about 25V.

39. The method according to claim 38, wherein the AC voltage has a maximum value of about +15V and a minimum value of about −15V.

* * * * *